US005667010A

United States Patent [19]

Boyd et al.

[11] Patent Number: 5,667,010

[45] Date of Patent: Sep. 16, 1997

[54] PROCESS AND PLUG FOR WELL ABANDONMENT

[75] Inventors: John Wesley Boyd; John Balslev Jorgensen; Victor Freeman Maxwell, all of Calgary, Canada

[73] Assignee: Steelhead Reclamation Ltd., Calgary, Canada

[21] Appl. No.: 408,156

[22] Filed: Mar. 21, 1995

[51] Int. Cl.[6] ..... E21B 33/138

[52] U.S. Cl. ..... 166/292; 126/192

[58] Field of Search ..... 166/285, 289, 166/290, 291, 292, 294, 277, 298, 179, 192

[56] References Cited

U.S. PATENT DOCUMENTS

| | | | |
|---|---|---|---|
| 1,491,427 | 4/1924 | Smit | 166/285 |
| 2,164,266 | 6/1939 | Armentrout et al. | 166/285 |
| 3,901,316 | 8/1975 | Knapp | 166/250 |
| 3,995,694 | 12/1976 | Freiburger | 166/285 |
| 4,173,999 | 11/1979 | Messenger | 166/293 |
| 4,736,796 | 4/1988 | Arnall et al. | 166/292 |
| 4,842,063 | 6/1989 | Coetzee et al. | 166/285 |
| 4,869,323 | 9/1989 | Stags | 166/289 X |
| 4,898,242 | 2/1990 | Jennings, Jr. et al. | 166/285 |
| 4,909,323 | 3/1990 | Hastings | 166/289 X |
| 4,966,237 | 10/1990 | Swanson et al. | 166/292 |
| 5,004,298 | 4/1991 | Boulanger et al. | 166/292 X |
| 5,105,879 | 4/1992 | Ross | 166/195 |
| 5,159,980 | 11/1992 | Onan et al. | 166/294 |
| 5,199,489 | 4/1993 | Johnson et al. | 166/292 X |
| 5,293,939 | 3/1994 | Surles et al. | 166/295 |

OTHER PUBLICATIONS

Canadian Association of Petroleum Producers brochure "Surface Abandoment and Reclamation in Alberta" date: Unknown.

Energy Resources Conservation Board "Well Abandonment Guide" first published Aug. '91, Revised Aug. '94.

Amoco Petroleum "Amoco Drilling Manual" pages describing abandoment plugs—date: Aug. 2, 1901.

"Gas Migration in Heavy Oil—Somehistory" J. Edson publication date: not known—first became aware of it Summer 1993.

*Primary Examiner*—William P. Neuder

*Attorney, Agent, or Firm*—Bennett Jones Verchere

[57] ABSTRACT

A plug and process for use in well abandonment is taught. The plug includes a retaining structure, such as a cement plug, which is placed in the well borehole and an amount of a viscous substance, such as sand and fines in bitumen, above the retaining structure. The viscous substance prevents the passage of fluids vertically through the well borehole. The plug remains viscous over time and can flow to fill void which may open up in the well adjacent the plug. To enhance the sealing characteristics of the plug, the process for placement of the plug includes the removal of a section of the well casing and possibly also the sheath and a layer of the borehole wall behind the removed section of the casing at the position of the plug to prevent the flow of fluids around the plug.

20 Claims, 4 Drawing Sheets

PROCESS AND PLUG FOR WELL ABANDONMENT

FIELD OF THE INVENTION

This invention is directed to petroleum well abandonment and in particular, a process and plug for abandoning a well.

BACKGROUND OF THE INVENTION

When a well borehole is drilled to gain access to a prospective production zone, the original natural seal in the form of impermeable rock, termed cap rock, is disturbed. In abandoning the well, the seal must be reestablished to prevent the vertical migration of fluids through the well from the production zone. It is desirable that any borehole seal have the same sealing characteristics as the original seal.

During construction of a well, the drilled borehole is usually cased with steel. Often a cement sheath is placed about the casing to form a seal between the casing and the wall of the borehole. The conventional abandonment technology assumes permanent integrity of the casing to maintain the seal. Flow of fluid within the casing is controlled by setting a bridge plug in combination with cement plugs. Attempts to control flows outside the casing usually entail perforating the casing and injecting a cement slurry into the annulus. However, there are certain drawbacks associated with this procedure. For example, the force of the perforating charge and the pressure of the cement injection behind the casing can cause fracturing in the surrounding formation which may provide a path for fluid leaks about the plug. Further, because of the contamination of the borehole wall by the cement sheath and other substances such as oil, leakage can occur at the cement/formation and cement/casing interfaces. In addition, such a plug is not permanent since its integrity is reliant on the life of the steel casing, corrosion and disintegration of which will in itself create a conduit for future flow. It is desirable that a permanent plug be available for one-time abandonment.

SUMMARY OF THE INVENTION

A process and plug have been invented for well abandonment which can be substantially permanent.

In accordance with a broad aspect of the present invention, there is provided a process for sealing a borehole comprising: placing a retaining means in the borehole; and, placing an amount of a viscous material into the borehole into contact with the borehole above the retaining means, such that the viscous material is prevented from moving down the well bore by the retaining means.

In accordance with another broad aspect of the present invention, there is provided a process for sealing a well, the well comprising a borehole lined with a casing, the process comprising: placing a retaining means in the borehole; removing substantially all of a cylindrical section of the casing and, placing an amount of a viscous material into the borehole, to fill a portion of the borehole, above the retaining means, such that the viscous material is prevented from moving down the borehole by the retaining means.

In accordance with a further broad aspect of the present invention, there is provided a plug for use in well abandonment comprising: a lower support layer within the borehole; and an upper layer formed of a viscous material.

DESCRIPTION OF THE INVENTION

The process and plug of the present invention can be used in well boreholes which have been cased or cased and sheathed. They can also be used in wells which have not had casing and sheaths placed therein.

The plug includes a viscous material which is placed in the well borehole. The viscous material functions as the sealing portion of the plug to prevent the passage of fluids past the plug. A viscous material which is useful in the present invention is a material which will remain viscous over time, in borehole conditions, and retain the ability to flow to block fissures and openings. The viscous material must be of sufficient viscosity to prevent the leakage and loss of the material into fissures and porous material. In a preferred embodiment, the viscous material contains a gradation of sizes of solid material, such as sand and clay fines, to enhance the plugging and sealing characteristics of the material. The viscous material must also have a density greater than water so that it will not be displaced by water which may be present in the borehole. It has been found that a viscous, bituminous material, such as sand and fines in bitumen, commonly known as oil sand, or oil sand derivatives, is useful for forming the plug. For example oil sand, having a high viscosity (generally about 500,000 centipoise at 15° C.), can flow to seal tiny channels in the surrounding formation, is generally inert and will continue to be viscous, over time, to flow to fill any channels or voids which may arise, such as by the disintegration of the casing material. Oil sand has a specific gravity greater than that of water (generally a specific gravity from about 1.01 to 2.0) and so will not be displaced by water in the borehole. Further, oil sand is often readily available and the use of bituminous material does not act to introduce non-naturally occurring materials to the environment.

The plug further includes a retaining means to maintain the placement of the viscous material and to prevent the viscous material from passing down the borehole. Suitable retaining means are, for example, a bridge plug or a cement platform which extends across the opening of the well to engage the sides of the well about its entire circumference. Since the retaining means acts to prevent the viscous material of the plug from passing down the borehole and out of its sealing position, the permanency of the plug can be controlled by the selection of the retaining means. For example, a bridge plug can be used to temporarily retain the viscous material of the plug, while the use of a cement platform as the retaining means can be used to retain the viscous material indefinitely, thereby forming a substantially permanent plug. The materials used to form the retaining means are preferably selected with consideration as to the borehole conditions. For example, where a formation produces hydrogen sulphide, the retaining means is preferably formed of sulphate resistant materials, such as sulphate resistant cement.

The sealing properties of the plug are provided by the hydrostatic pressure which forces the bituminous material into fissures and into close contact with the structures in the borehole and acts against the pressure of fluids in the production zone. The hydrostatic pressure can be increased by increasing the amount of viscous material used to form the plug. In one embodiment, the viscous material extends from the retaining means to the surface opening of the borehole. Additional hydrostatic pressure can be provided by the presence, above the viscous material, of a liquid having a lower density than the viscous material. In an embodiment, the viscous material is a bituminous-sand-fines mixture and the liquid is water.

The plug is placed in the portion of the well which passes through a layer of impermeable rock to prevent the passage of fluids between the productive zone and the upper permeable layers. The process for placement of the plug can include a preliminary examination of data related to the borehole to locate the position of the impermeable rock layer. Further, in the preferred embodiment the borehole and well data is examined to determine additional information, for example: the pressure of the fluids in the productive zone, which will determine the hydrostatic pressure which is required to effect a seal; the diameter of the borehole at the selected position of the plug, to estimate the amounts of plug materials required; and the most likely source of fluids that may migrate up the borehole, to determine if the fluids are hazardous or corrosive and to estimate the desired location of plugs and the pressures they must withstand. In addition, a determination is made of the necessity of forming additional casing windows for sealing shallower production zones.

The retaining means is then placed in the borehole below the selected position of the viscous material which forms the sealing portion of the plug. The viscous material must be placed in the borehole such that it can flow to seal the passage of fluids about the plug. Thus, in a cased well, the well is prepared for placement of the viscous material by removing a portion of the casing. After removal of the casing, the viscous material can flow unimpeded into any voids behind the casing. While it is preferred that an entire cylindrical section of the casing be removed, it is to be understood that substantially all of a cylindrical portion of the casing can be removed such that the viscous material can flow to fill the voids behind the casing. In one embodiment, a cylindrical portion of the casing, the sheath behind this portion of the casing and a portion of the exposed borehole wall are removed, such as by milling or grinding, prior to placement of the viscous material. By such an operation, a section is formed in the borehole which is free of material which may provide a conduit for the passage of fluids about the plug. This milling or grinding operation is also useful in the abandonment of an uncased borehole to remove any surface contamination, thereby enhancing the integrity of the seal provided by the plug. Preferably, the removal of a portion of the borehole wall is carried out in a manner which substantially avoids fracturing of the rock. Preferably, the portion of the borehole which has been prepared for the viscous material is at least 2 meters long to allow some margin of error in the positioning of the plug at an impermeable rock layer.

Where the borehole has been prepared for placement of the viscous material by removing a portion of the casing, the retaining means should be positioned to block any large voids through which the viscous material may pass down the borehole, past the retaining means.

Once the retaining means is placed and the borehole is prepared, the viscous material is applied on top of the retaining means. An amount of viscous material is added to fill any voids in the borehole and to effect a seal against the pressure of fluids moving up the well from the production zone. Further, an amount of viscous material is preferably used which can flow to fill voids which may arise over time.

If desired, the liquid is then added above the viscous material. Liquid such as water may also be present in the borehole as a result of the milling operation. This liquid will be displaced up the borehole by placement of the viscous material and therefore will be present above the viscous material and can remain there.

The present plug can be used in the abandonment of a well which passes through a plurality of production zones. The plug can be placed at the uppermost layer of impermeable rock, or alternatively, where the placement of the plug would not be effective against the combined pressure of the productive zones, a retaining means can be placed such that the viscous material is able to extend through a plurality of productive zones. A cylindrical section of the casing or casing and surrounding cement and borehole wall is removed at each impermeable layer between the production zones.

BRIEF DESCRIPTION OF THE DRAWINGS

A further, detailed, description of the invention, briefly described above, will follow by reference to the following drawings of specific embodiments of the invention. These drawings depict only typical embodiments of the invention and are therefore not to be considered limiting of its scope. In the drawings.

DETAILED DESCRIPTION OF THE PRESENT INVENTION

The plug of the present invention can be used in uncased, cased or cased and sheathed wells.

Figure 1:
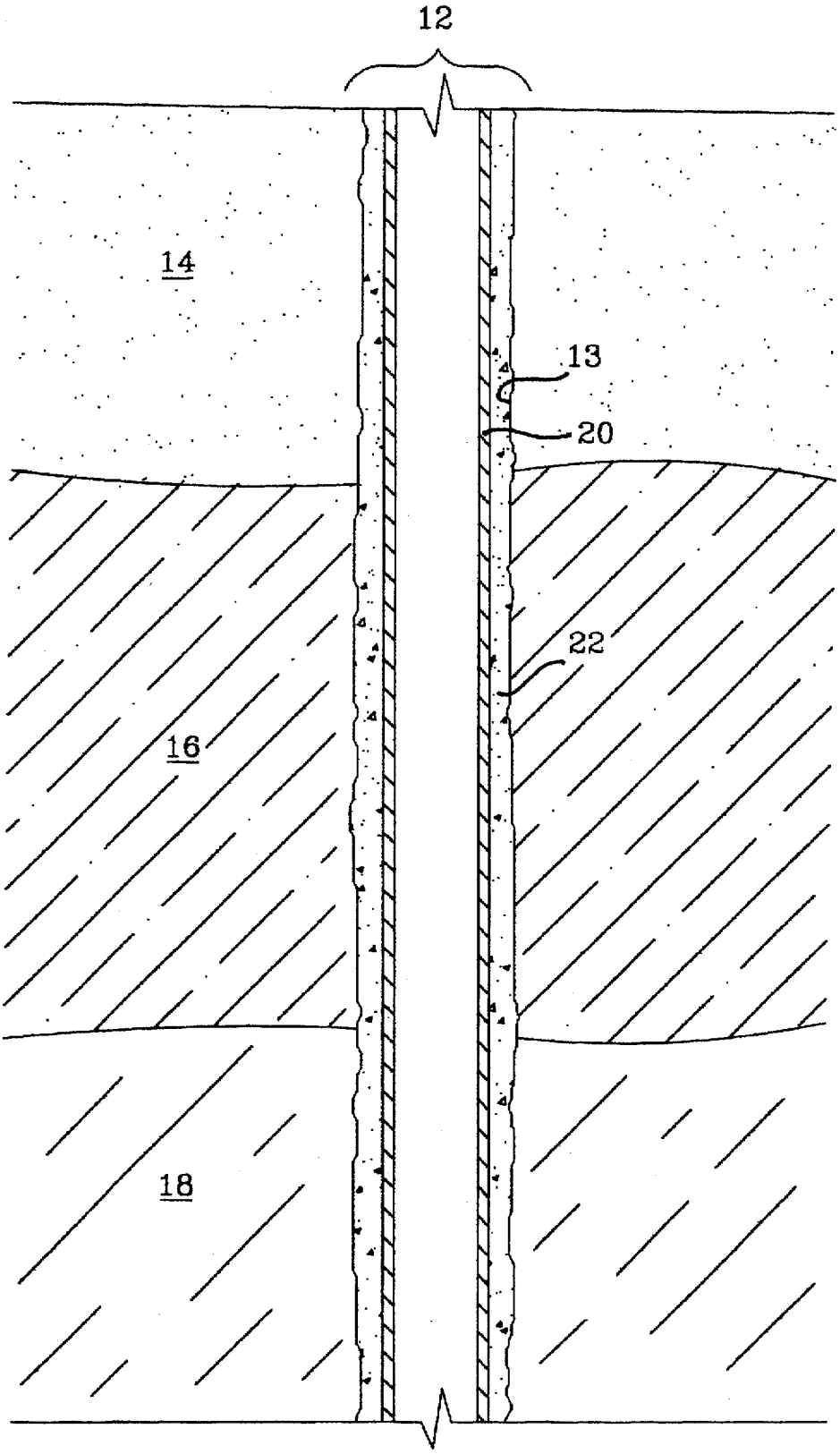
FIG. 1 shows a schematic representation of a section along a well.

Referring to FIG. 1, a sectional schematic view of a conventional cased and sheathed well having a borehole, indicated at 12 and defined by walls 13, which passes through a formation including an upper permeable layer 14 and an impermeable rock layer 16 into a production zone 18. Within borehole 12 is a casing 20 formed of steel. A cement sheath 22 is positioned about casing 20. Prior to abandonment, the well is substantially uniform having the arrangement of casing and sheath along at least the lower length of the borehole, as shown.

Figure 3:
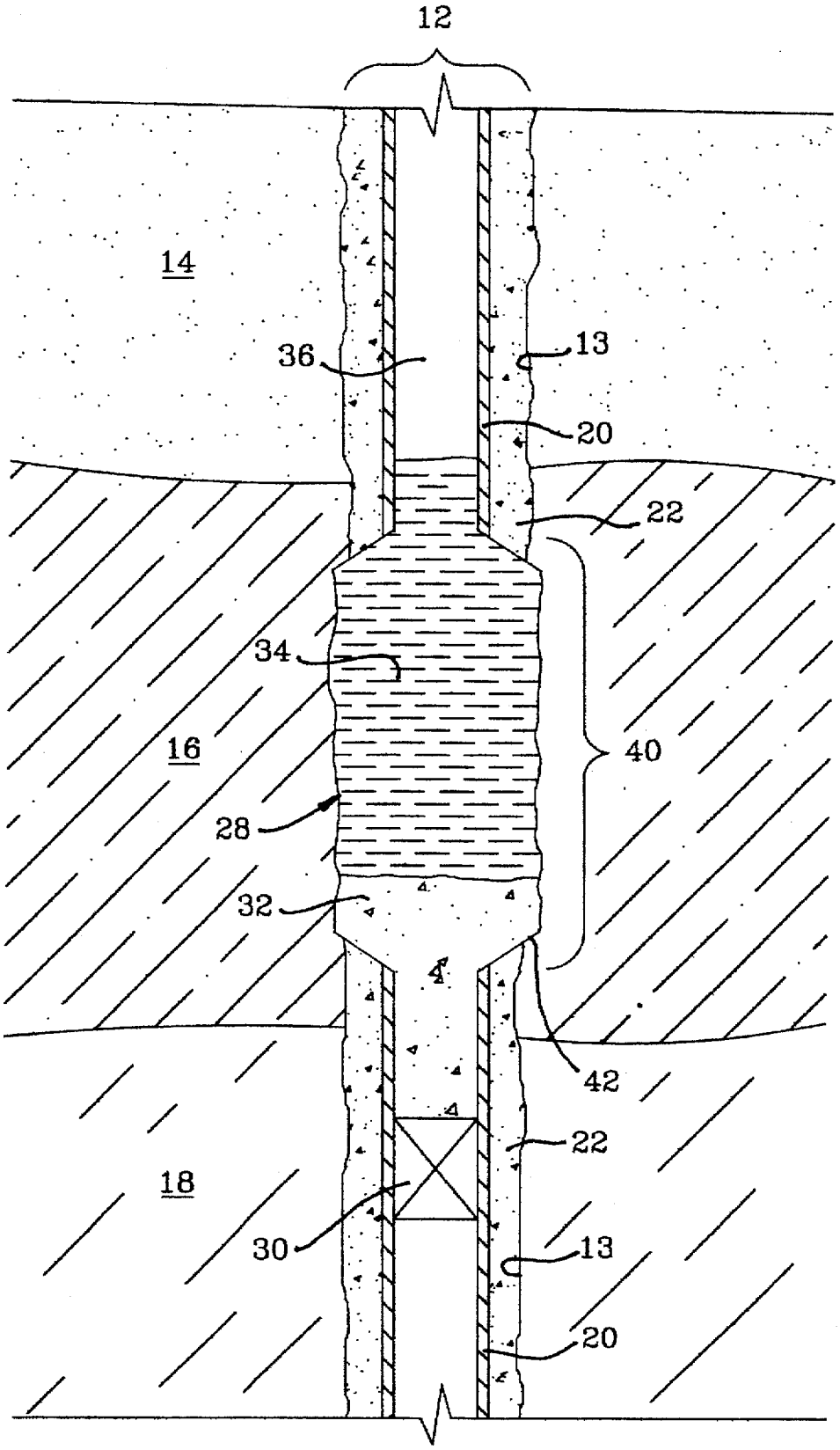
FIG. 3 shows a schematic representation of a section along a plug according to the present invention, the plug being positioned within a well; and, FIG. 4 shows a schematic representation of a section along a plug according to the present invention, the plug being positioned within a well which passes through a plurality of productive zones.

Referring to FIG. 3, a sectional schematic view of a preferred plug 28 is shown. Plug 28 is placed in borehole 12 of a well to prevent the passage of gas and liquid through the well. Plug 28 includes a bridge plug 30, a layer 32 of cement above bridge plug 30, a mixture of sand and fines in bitumen 34 and an amount of water 36 disposed above mixture 34.

Bridge plug 30 is provided to maintain cement layer 32 in its selected position during setting thereof and to initially prevent migration of fluid within the casing until bitumen mixture 34 is placed. Cement layer 32, when set, acts to retain mixture 34 in its selected position. Water 36 is present above mixture 34 to provide additional hydrostatic force on the mixture. The total hydrostatic force of the mixture and the water causes the mixture to be forced into cracks in the borehole wall and any openings between the cement plug and the wall. Mixture 34 is also brought into close contact with the walls 38 of borehole 12 by the hydrostatic force, and will continue to do so as the casing disintegrates.

Figure 2:
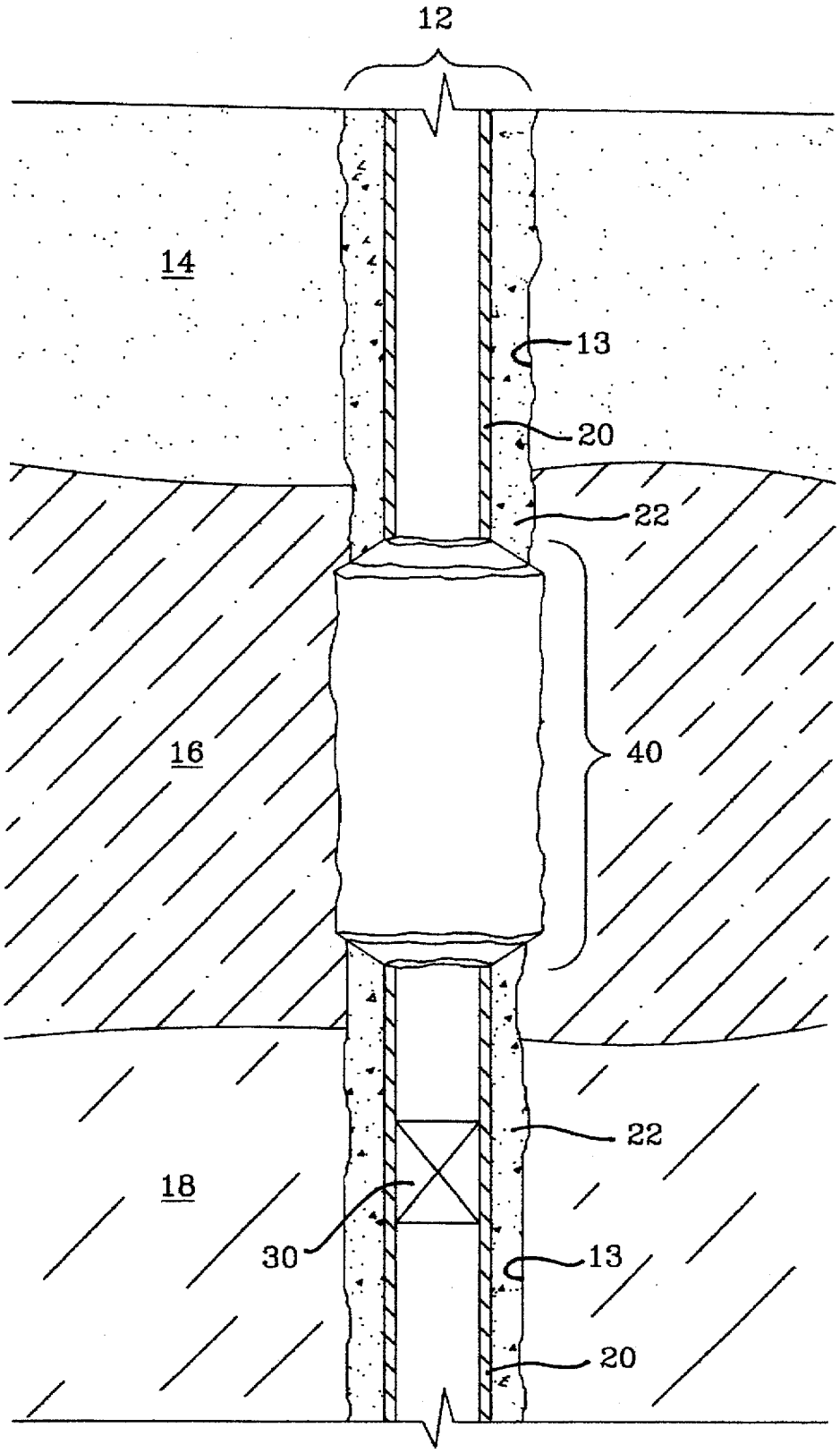
FIG. 2 shows a schematic representation of a section along a well, the well having had a cylindrical section of its casing and sheath and a portion of the borehole wall removed according to the process of the present invention.

The preferred process for placement of plug 28 can be better understood by referring to FIGS. 1, 2 and 3. After examination of well information, bridge plug 30 is placed at a selected location, above which plug 28 will extend. As best seen in FIG. 2, at a position above bridge plug 30, a section of the well is milled out to remove a cylindrical portion of the casing, the sheath behind the casing and a layer of the borehole wall to form a section, indicated at 40. At least a portion of section 40 is within impermeable rock layer 16.

The placement of bridge plug 30 prior to milling acts to prevent complications in the placement of the bridge plug, and is therefor preferred. It is to be understood, however, that the bridge plug can be placed after milling.

Cement is then placed down the well to form a layer 32 above bridge plug 30. The amount of cement which is placed down the well is selected to be sufficient to extend up the well and into section 40. Thus, after sufficient time elapses for the cement to set, cement layer 32 is firmly held in borehole 12. The cement is preferably sulphate-resistant to resist corrosion by the effect of the contact of hydrogen sulphide with water. A shoulder 42 is formed in the borehole during formation of section 40 which can act to retain layer 32 so that it will not be displaced should the casing and sheath below the cement layer break down.

Mixture 34 is then heated, to reduce its viscosity temporarily, enabling it to be pumped down the well and onto cement layer 32. With consideration as to the fluid pressure in the production zone, sufficient mixture 34 is provided to the well to resist the passage of fluids from the production zone, even after the disintegration of the casing. The amount of the mixture which is required can be determined by first finding the product of the specific gravity of the mixture and the hydrostatic pressure of water, to determine the hydrostatic pressure of the mixture, and then dividing this value into the value of the fluid pressure in the productive zone, to determine the column height of the mixture which is required. The volume of the borehole is then considered to determine the amount of the mixture which is required. A margin of safety can be added by increasing the amount of the mixture added to the well beyond that amount calculated.

As an example, assuming that the specific gravity of the bituminous material used in the plug is 1.01, the hydrostatic gradient provided by the bitumen would be:

$$1.01\times10\text{kPa/m}=10.1\text{kPa/m}.$$

Assuming that the pressure of the migrating fluid was found to be 1,000 kPa, the height of the column of bitumen required to offset this pressure would have to be at least:

$$1{,}000\text{kPa}/10.1\text{kPa/m}=99.01\text{m}.$$

In order to provide a 25% margin of safety, the column could be increased to:

$$99.01\text{m}\times1.25=123.76\text{m}.$$

Assuming that the volume factor of the well was 0.01 $m^3/m$, the amount of bitumen required to form the plug would be:

$$123.76\text{m}\times0.01\text{m}^3/\text{m}=1.26\text{m}^3.$$

To increase the hydrostatic pressure of the plug, the bitumen could be introduced into the well until the column of bitumen extended to the surface opening of the well.

To increase the hydrostatic pressure, water 36 is present above mixture 34. The water can be added to the borehole or can be present during placement of the plug. In the above example, a column of water could be used to supplement the hydrostatic pressure of the plug.

Figure 4:
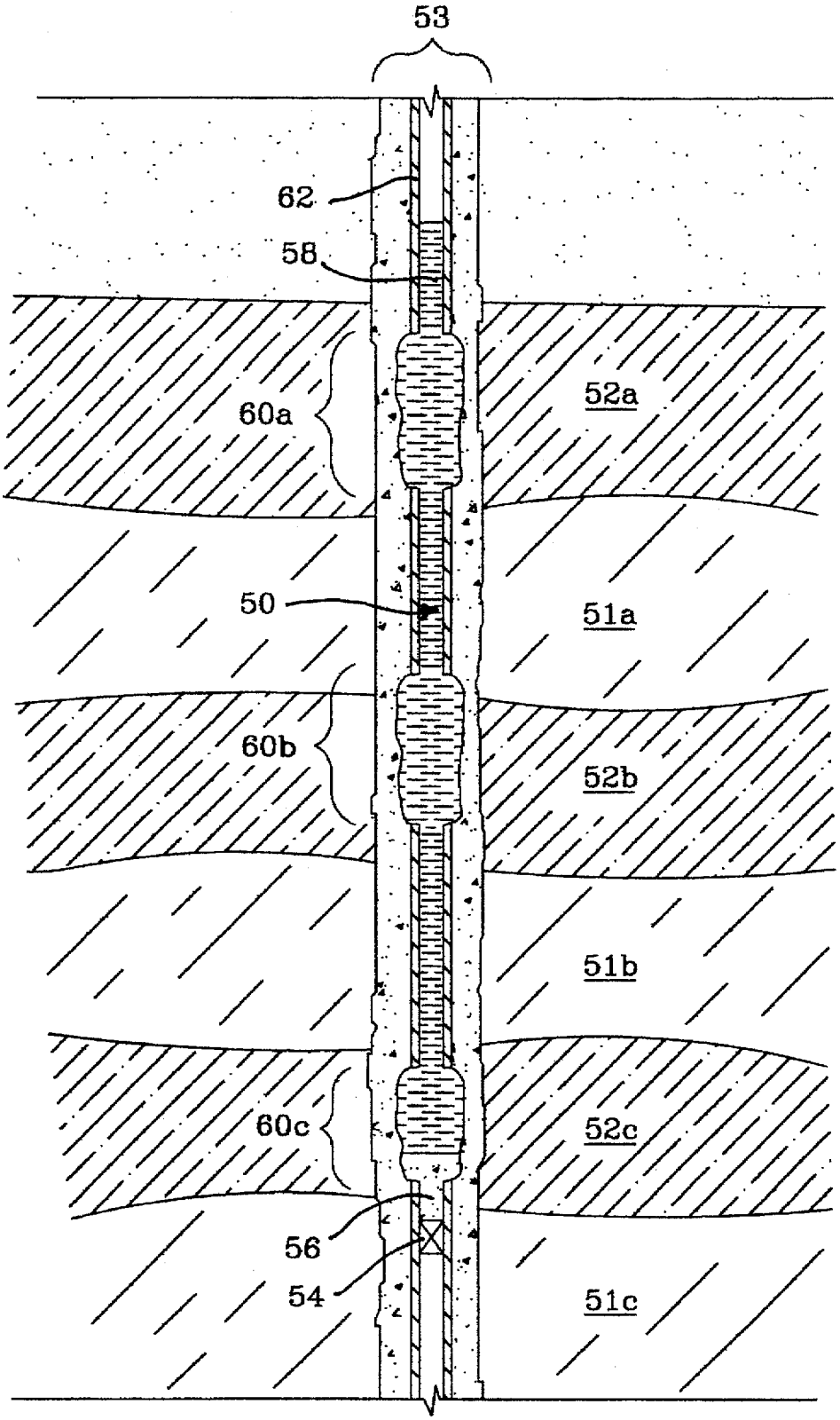

Referring to FIG. 4, a sectional schematic view of a plug 50 is shown. Plug 50 is useful for placement in the borehole 53 of a well which passes through a plurality of production zones 51*a*, 51*b*, 51*c* and cap rock layers 52*a*, 52*b*, 52*c* to prevent the passage of fluids through the well, using the wellbore as a conduit. Plug 50 includes a bridge plug 54, a layer 56 of cement above bridge plug 54 and a mixture of sand and fines in bitumen 58 above layer 56.

So that fluids are prevented from passing up the borehole, sections 60*a*, 60*b* and 60*c* are formed in the well by removal of a section of the casing 62 within the borehole at locations adjacent to layers 52*a*, 52*b*, 52*c* so that mixture 58 can flow to fill any voids which existed behind the casing at these locations.

It will be apparent that many other changes may be made to the illustrative embodiments, while falling within the scope of the invention and it is intended that all such changes be covered by the claims appended hereto.

The embodiments of the invention in which an exclusive property or privilege is claimed are defined as follows:

1. A process for sealing a borehole comprising:

placing a retaining means in the borehole; and, placing an amount of a bituminous material into the borehole into contact with the borehole above the retaining means, such that the bituminous material is prevented from moving down the well bore by the retaining means and the bituminous material is positioned in the borehole such that it is adjacent to an impermeable rock layer through which the borehole passes, the bituminous material being selected to remain viscous over time in borehole conditions, to retain its ability to flow.

2. The process of claim 1 wherein the retaining means is an amount of cement to fill a portion of the borehole.

3. The process of claim 1 wherein a surface layer of the impermeable rock layer is removed prior to placement of the viscous material.

4. The process of claim 1 wherein the bituminous material is a mixture of sand and fines in bitumen.

5. The process of claim 1 wherein the amount of bituminous material added is sufficient to effect a seal against the pressure of fluids moving up the borehole.

6. The process of claim 1 wherein the bituminous material has a density greater than water.

7. A process for sealing a well, the well having a borehole lined with a casing, the process comprising:

placing a retaining means in the borehole;

removing substantially all of a cylindrical section of the casing adjacent to an impermeable rock layer through which the borehole passes; and, placing an amount of a viscous material into the borehole to fill a length of the borehole above the retaining means, the viscous material being selected to remain viscous over time in borehole conditions, to retain its ability to flow.

8. The process of claim 5, the well further having a sheath disposed about the casing and the process further comprising: removing substantially all of the sheath exposed by removal of the casing prior to placement of the viscous material.

9. The process of claim 8 further comprising: removing a surface portion of the impermeable rock layer exposed by removal of the casing and the sheath, prior to placement of the viscous material.

10. The process of claim 7 wherein the retaining means is an amount of cement to fill a portion of the borehole.

11. The process of claim 7 wherein the viscous material is a mixture of sand and fines in bitumen.

12. The process of claim 7 wherein the viscous material is a bituminous material.

13. The process of claim 7 wherein the viscous material has a density greater than water.

14. The process of claim 7 wherein the amount of viscous material added is sufficient to effect a seal against the pressure of fluids moving up the borehole.

15. A process for sealing a well, the well having a borehole lined with a casing, the process comprising:

placing a bridge plug in the borehole;

removing a cylindrical section from the casing to eliminate the casing as a continuous medium at a position above the bridge plug and adjacent to an impermeable rock layer of a formation through which the well extends;

removing a surface layer of the impermeable rock exposed by removal of the casing to form an enlarged borehole section;

introducing an amount of cement onto the bridge plug, the amount of cement being sufficient to fill a length of the borehole and extending upwardly from the bridge plug into the enlarged borehole section;

allowing the cement to set; and, placing an amount of a viscous material into the borehole and onto the cement, the amount of the material being sufficient to fill a length of the borehole.

16. The process of claim 15, the well further having a sheath disposed about the casing and the process further comprising: removing substantially all of the sheath exposed by removal of the casing prior to removal of the surface layer of the impermeable rock layer.

17. The process of claim 15 wherein the amount of viscous material added is sufficient to effect a seal against the pressure of fluids moving up the borehole.

18. A plug for use in sealing a borehole comprising:

an upper sealing layer of bituminous material selected to remain viscous over time in borehole conditions, to retain its ability to flow; and a lower layer for retaining the upper layer in position in the borehole.

19. The plug of claim 18 wherein the bituminous material is sand and fines in bitumen.

20. The plug of claim 18 wherein the upper layer is present in an amount sufficient to effect a seal against a pressure exerted by any fluids moving up the borehole.

* * * * *